United States Patent [19]

Raghavan

[11] 4,013,459

[45] Mar. 22, 1977

[54] OXIDATION RESISTANT NICKEL BASE ALLOYS

[75] Inventor: Mathur Raghavan, Hamden, Conn.

[73] Assignee: Olin Corporation, New Haven, Conn.

[22] Filed: Oct. 24, 1975

[21] Appl. No.: 625,553

[52] U.S. Cl. ..... 75/171; 75/170; 148/2; 148/11.5 N; 148/32

[51] Int. Cl.[2] ..... C22C 19/05

[58] Field of Search ..... 75/170, 171; 148/32, 148/11.5 N, 2

[56] References Cited

UNITED STATES PATENTS 3,744,996 7/1973 Shaw et al. ..... 75/171

3,810,754 5/1974 Ford et al. ..... 75/171

*Primary Examiner*—R. Dean

*Attorney, Agent, or Firm*—Robert H. Bachman; Robert A. Dawson

[57] ABSTRACT

Improved oxidation resistant nickel base alloys, and processing thereof, consisting essentially of from 2 to 6% aluminum, from 0.5 to 4% silicon, from 0.001 to 0.5% of a material selected from the group consisting of the elements of the lanthanide series of the Periodic Table and mixtures thereof, preferably mischmetal, and the balance essentially nickel.

10 Claims, No Drawings

OXIDATION RESISTANT NICKEL BASE ALLOYS

BACKGROUND OF THE INVENTION

Nickel base alloys represent an important class of commercial alloys which are commonly used in applications where good mechanical properties are important, such as high temperature strength and corrosion resistance. The art has long sought and continues to actively seek new and improved nickel base alloys where the properties of high temperature strength and corrosion resistance are improved, together with improvement of other mechanical properties such as hot workability, creep resistance and high creep rupture strength.

Typical nickel alloys such as Monel (70% nickel, 30% copper), are found to be highly susceptible to high temperature corrosion known as oxidation-sulfidation when exposed to high temperature gases containing oxygen and sulfur components. The mechanism of the oxidation-sulfidation attack is an intergranular one and the affected alloys often crumble apart. It is obviously highly desirable to provide improved nickel base alloys having good oxidation-sulfidation resistance.

In accordance with U.S. Pat. No. 3,810,754 a series of oxidation resistant nickel base alloys are provided. It is desirable to provide still further improvement in the oxidation resistance of this type of alloys, while providing a combination of good mechanical properties such as good hot workability, good creep resistance and high creep rupture strength.

SUMMARY OF THE INVENTION

The improved oxidation resistant nickel base alloys of the present invention consist essentially of from 2 to 6% aluminum, 0.5 to 4% silicon, 0.001 to 0.5% of a material selected from the group consisting essentially of the elements of the lanthanide series of the Periodic Table and mixtures thereof, balance essentially nickel. The alloys of the present invention preferably contain chromium in an amount from 1 to 6%.

It has been found that the nickel base alloys of the present invention have extremely high resistance to deterioration under oxidation-sulfidation conditions at elevated temperatures. This resistance to high temperature corrosion renders the alloys of the present invention highly desirable in certain high temperature applications, such as automotive exhaust systems, catalytic converters, certain portions of jet engines and certain components in chemical process plants. In addition, the improved nickel base alloys of the present invention have been found to possess a surprisingly good combination of mechanical properties which render them especially suitable for a variety of applications, for example, the alloys have excellent hot workability, good creep resistance and high creep rupture strength.

It is, therefore, a primary object of the present invention to provide improved nickel base alloys having extremely high resistance to oxidation-sulfidation corrosion at elevated temperatures.

It is a still further object of the present invention to provide an improved nickel base alloy as aforesaid having a surprising good combination of mechanical properties.

It is a still further object of the present invention to provide improved nickel base alloys as aforesaid characterized by relatively low cost and ease of manufacture.

DETAILED DESCRIPTION

The alloys of the present invention achieve a surprising combination of high temperature corrosion resistance under oxidation-sulfidation conditions coupled with a combination of good mechanical properties through the careful selection of alloying ingredients. Each of the alloying elements used in the alloys of the present invention contribute to the improvement of mechanical properties and corrosion resistance over that of pure nickel. This is achieved by selecting the alloying additions so that each alloying addition effectively decreases the stacking fault energy of the alloy, thereby effecting the dislocation behavior of the alloy and its mechanical strength as discussed in detail in the aforesaid U.S. Pat. No. 3,810,754. The alloying constituents also form complex oxides on the surface of the alloy at elevated temperatures. These oxides may be controlled and may be made extremely protective to the surface of the alloy by carefully controlling the concentration of the solute additions which form the oxides.

In accordance with the present invention, a nickel base alloy is provided containing from 2 to 6% aluminum, and preferably from 3 to 5% aluminum. The silicon range will vary from 0.5 to 4% silicon and preferably from 2 to 3.5% silicon. Chromium is a preferred additive in the alloys of the present invention. The chromium range will vary from 1 to 6% chromium and preferably from 3 to 5% chromium.

The alloys of the present invention contain from 0.001 to 0.5% of a material selected from the group consisting of the elements of the lanthanide series of the Periodic Table and mixtures thereof. Preferably, one uses mischmetal as the lanthanide component and generally one uses at least 0.01% of the lanthanide component. The term mischmetal describes the material composed largely of the lanthanides comprising elements No. 58–71 of the Periodic Table. A type mischmetal composition is listed below.

Cerium — 50%
Lanthanium — 27%
Neodymium — 16%
Praseodymium — 5%
Other Rare Earth Metals — 2%

However, as used in this application the term mischmetal is intended to include any material comprised predominately of a metal of the lanthanide series regardless of the relative proportions thereof. For example, cerium alone could be used in place of mischmetal and would provide equally satisfactory results.

The balance of the alloy is essentially nickel. Other additives may be included in order to provide particular improvement or accentuate particular properties. As indicated aforesaid, the alloys of the present invention have extensive resistance to deterioration under oxidation-sulfidation conditions at elevated temperatures. In addition, it is well known in the metallurgical art that the presence of even a trace amount of sulfur in high nickel alloys can cause great difficulty in hot rolling. The addition of manganese in an amount from 0.001 to 0.4% will aid in overcoming this difficulty. The manganese addition has a negligible effect upon the properties of the alloy and, hence, is a desirable additive. A further minor element which may be effectively added to the alloys of the present invention is magnesium which may be included for further deoxidation of the alloy as necessary as well as for providing still further improvement in the oxidation resistance thereof. The magnesium may be included in an amount from 0.001 to 0.1%. Due to the fact that the alloy of the present invention already contains deoxidizers, such as aluminum which serves as a strong deoxidizer, the magnesium addition is optional and is not absolutely required. It has been found that the magnesium addition also provides additional oxidation resistance and, hence, may be desirable.

A particular advantage of the lanthanide addition is that it is surprisingly effective in counteracting the harmful effects of residual trace elements and thereby provides significant improvement in hot workability. In addition, the alloys of the present invention possess surprisingly good mechanical properties, such as good creep resistance and high creep rupture strength.

The processing of the alloys of the present invention is not particularly critical and the alloys may be readily processed commercially in accordance with standard techniques. Because of the reactive nature of the additives of the present invention, it is highly desirable to add the lanthanide metal in a continuous form immediately before the molten metal enters the mold. This form of addition is particularly practical in a continuous casting operation. Reference is made to U.S. Pat. No. 3,738,827 which deals with this subject. Because of its reactivity, magnesium may be added in a similar fashion, although this is not absolutely necessary.

The alloys of the present invention may be readily processed into desirable wrought products. The material may be hot rolled at a temperature of at least 1470° F and generally below 2100° F following a homogenization treatment in the same temperature range for 30 minutes to 24 hours. Naturally, if a plurality of hot rolling passes are employed the material should be reheated after each pass, as, for example, a 10 minute reheat at temperature. The material may then be cold rolled to desired gage with intermediate anneals at a temperature of from 1500°–1900° F, and preferably from 1700° to 1850° F, for from 5 seconds to 8 hours, especially where good ductility is desirable. Strip or Bell annealing can be readily employed.

The present invention will be more readily understood from a consideration of the following illustrative examples wherein all percentages are weight percentages.

EXAMPLE I

A 5 lb. ingot (1.75 × 1.75 × 4 inches) identified as Alloy A having the composition set forth in Table I, below was melted in an alumina crucible and cast in a cast iron book mold, with the mischmetal being added immediately before the molten metal entered the mold.

TABLE I — Alloy A

Aluminum — 4.0%
Chromium — 3.5%
Silicon — 2.1%
Mischmetal — 0.02%
Nickel — Essentially Balance The ingot was homogenized at 2000° F in air for about 3 hours and hot rolled at 1800° F, using a hot reduction schedule of 0.25 inch reduction per pass and a 10 minute reheat after each pass to a thickness of 0.5 inch. The hot rolled plate was mechanically ground to remove surface scale and cold rolled to a final gage of 0.02 inch with an intermediate anneal at 1800° F for 1 hour in an argon atmosphere. Specimens for oxidation tests were sheared to a size of 1 × 4 centimeters from the cold rolled sheets and chemically cleaned in boiling 5 Normal caustic soda for 20 seconds followed by 40% nitric acid at 81° C for 40 seconds.

EXAMPLE II

The specimens of Alloy A prepared in Example I were subjected to oxidation tests at a temperature of 1800° F in a 1% oxygen, 10% water, 89% nitrogen atmosphere. The test consisted of exposure to the temperature for 3 hours followed by a rapid cooling to room temperature, followed by holding for 1 hour at room temperature and repeating the cycle. Weight gain was computed after each cycle. This test simulates the environment of $NO_x$ catalyst device and illustrates the effectiveness of the alloys of the present invention in this environment. The oxidation behavior of Alloy A of the present invention was compared to that of the following commercial oxidation resistant nickel base alloys, identified as Alloys B, C and D, with the compositions thereof set forth in Table IA, below.

TABLE IA

| Alloy | COMPOSITION - WEIGHT PERCENT Chromium | Silicon | Aluminum | Iron | Nickel |
|---|---|---|---|---|---|
| B | 19.6 | 1.2 | — | — | Essentially Balance |
| C | 16.5 | 1.2 | — | 13.0 | Essentially Balance |
| D | 23.0 | — | 1.0 | 18.0 | Essentially Balance |

Commercially available specimens of the aforesaid comparative Alloys B, C and D in sheet form were sheared to a size of 1 × 4 centimeters and were chemically cleaned in a manner after Alloy A of the present invention. The comparative materials were subjected to the same oxidation test as Alloy A of the present invention. The data is shown in Table IB below.

TABLE IB

| Time - Hours | WEIGHT GAIN - Mg/cm² Alloy A | Alloy B | Alloy C | Alloy D |
|---|---|---|---|---|
| 20 | 0.170 | 0.270 | 0.470 | 0.630 |
| 60 | 0.290 | 0.420 | 0.720 | 0.970 |
| 100 | 0.360 | 0.520 | 0.880 | 1.250 |

The foregoing data clearly shows that the alloy of the present invention is significantly superior to the comparative alloys and is characterized by substantially less oxidation weight gain than any of the other samples tested.

EXAMPLE III

The presence of lead is known to be harmful in nickel alloys, for example, even amounts exceeding 0.002% may be quite harmful to hot processing. The alloys of the present invention counteract the harmful effect of lead and are processable without any difficulty. This is possibly due to the formation of compounds of lead with the reactive rare earth elements. This beneficial effect on processing is illustrated by the fact that Alloy E (having the same composition as Alloy A, but without the mischmetal component plus 0.0026% lead added) edge cracked severely during hot rolling; whereas, Alloy F (having the same composition as Alloy A plus 0.0025% lead added) processed without showing any cracking.

This invention may be embodied in other forms of carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A nickel base alloy consisting essentially of from 2 to 6% aluminum, from 0.5 to 4% silicon, from 1 to 6% chromium, from 0.001 to 0.5% of a material selected from the group consisting of the elements of the lanthanide series of the Periodic Table and mixtures thereof, balance essentially nickel.

2. An alloy according to claim 1 wherein said lanthanide material is mischemetal.

3. An alloy according to claim 1 wherein said lanthanide material is cerium.

4. An alloy according to claim 1 including an addition from 0.001 to 0.4% manganese.

5. An alloy according to claim 1 including an addition from 0.001 to 0.1% magnesium.

6. An alloy according to claim 1 having high resistance to oxidation and sulfidation at elevated temperatures, good hot workability, good creep resistance and high creep rupture strength.

7. An alloy according to claim 1 containing from 3 to 5% aluminum, from 2 to 3.5% silicon, from 3 to 5% chromium and from 0.01 to 0.5% of said lanthanide material.

8. A method of preparing a wrought nickel base alloy comprising:

A. providing a nickel base alloy consisting essentially of from 2 to 6% aluminum, from 0.5 to 4% silicon, from 1 to 6% chromium, from 0.001 to 0.5% of a material selected from the group consisting of the elements of the lanthanide series of the Periodic Table and mixtures thereof, balance essentially nickel;

B. hot rolling said alloy at a temperature of at least 1470° F; and

C. cold rolling said alloy to desired gage with intermediate annealing at 1500° to 1900° F for from 5 seconds to 8 hours.

9. A method according to claim 8 wherein prior to hot rolling the alloy is homogenized at a temperature of from 1470° to 2100° F for 30 minutes to 24 hours.

10. An alloy according to claim 1 in the wrought form.

* * * * *